United States Patent [19]

Hawkins et al.

[11] 4,348,068

[45] Sep. 7, 1982

[54] REFRIGERATOR CASING

[75] Inventors: Harold R. Hawkins; Clive A. Gardner; Lindsey J. Roke; Richard J. Clark; Warwick F. Rumble, all of Auckland, New Zealand

[73] Assignee: Fisher & Paykel Limited, Auckland, New Zealand

[21] Appl. No.: 114,329

[22] Filed: Jan. 22, 1980

[30] Foreign Application Priority Data

Jan. 26, 1979 [NZ] New Zealand ..... 189489

[51] Int. Cl.[3] ..... A47B 43/00; A47B 81/00

[52] U.S. Cl. ..... 312/257 R; 312/214; 312/236; 312/239

[58] Field of Search ..... 312/257 R, 257 SK, 257 SM, 312/257 A, 214, 236, 278, 100, 239, 283, 286

[56] References Cited

U.S. PATENT DOCUMENTS

| | | | |
|---|---|---|---|
| 459,697 | 9/1891 | Atkinson | 312/257 R |
| 2,393,879 | 1/1946 | Barnsteiner | 312/239 |
| 3,095,838 | 7/1963 | Paulos et al. | 312/214 |
| 3,236,405 | 2/1966 | Reil | 312/257 R |
| 3,365,535 | 1/1968 | Wilk | 312/100 |
| 3,399,941 | 9/1968 | Hansen et al. | 312/257 R |
| 3,520,581 | 7/1970 | Borghi | 312/236 |
| 3,740,109 | 6/1973 | Pfaffendorf et al. | 312/257 R |
| 3,868,153 | 2/1975 | Sholtes | 312/236 |
| 3,948,410 | 4/1976 | Anderson | 312/214 |
| 4,006,947 | 2/1977 | Haag et al. | 312/214 |
| 4,045,104 | 8/1977 | Peterson | 312/257 SK |

*Primary Examiner*—Victor N. Sakran

*Attorney, Agent, or Firm*—Holman & Stern

[57] ABSTRACT

A casing comprising a shell which has a transverse cross section in the form of an inverted square bottom "U". The bottom panel closes a part of the space between the ends of the arm of the "U" opposite to the top of the "U" and a back panel closes part of the space between the arms of the shell. The bottom panel and back panel do not extend to their common boundaries and a compartment panel is engaged between the back panel and the bottom panel.

3 Claims, 1 Drawing Figure

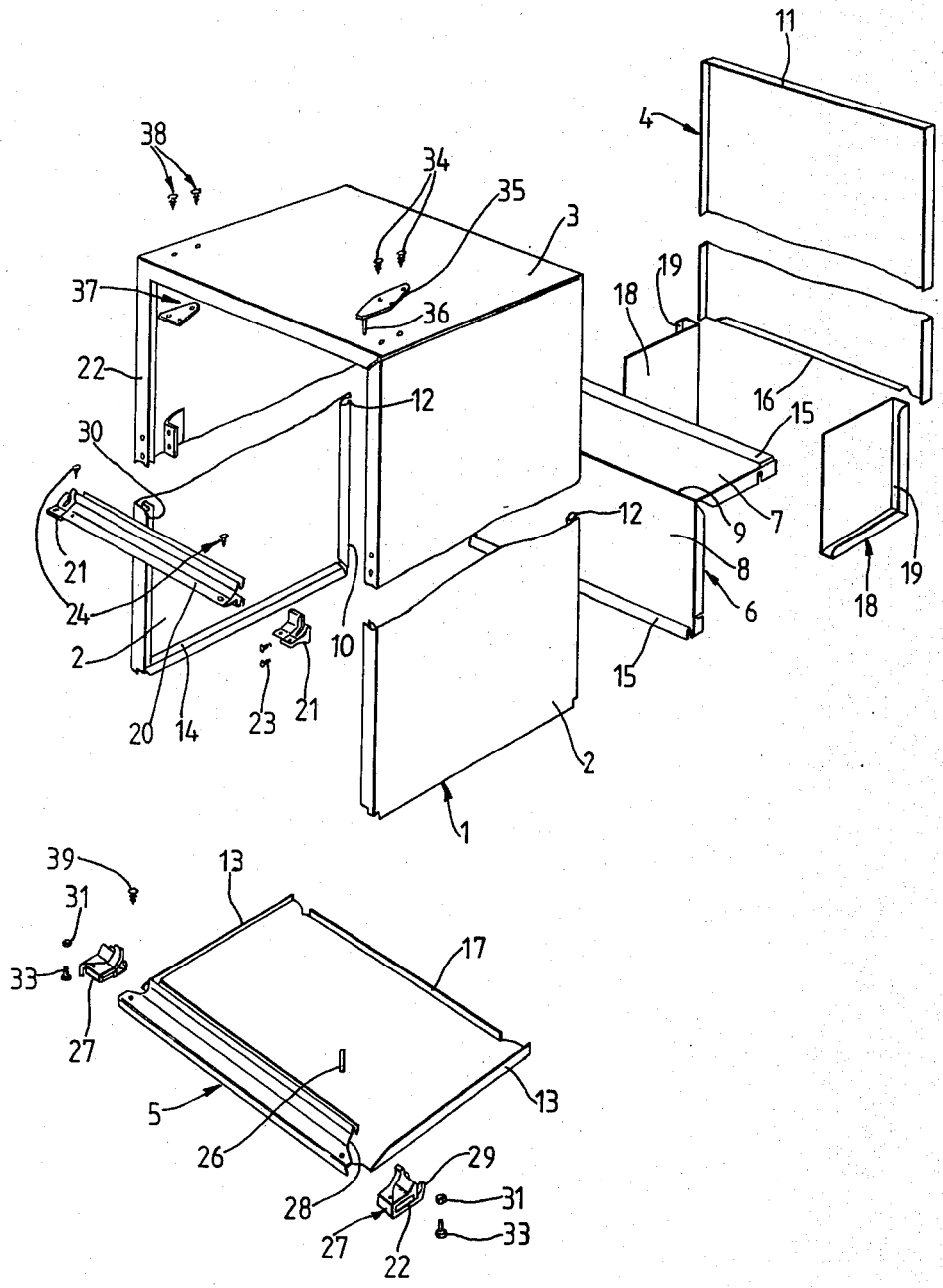
11
4
38
34
35
3
37
36
19
18
22
12
16
15
30
12
9
7
21
8
19
24
6
18
2
10
15
20
14
23
21
2
1
39
13
31
17
33
27
5
13
26
29
28
31
27
33
22

REFRIGERATOR CASING

BRIEF SUMMARY OF THE INVENTION

This invention relates to a casing and has been devised particularly though not solely for use as a refrigerator casing.

When forming casings, for example, for a refrigerator, refrigerator freezer combination, clothes dryers or clothes washers, it is desirable that the labor costs be reduced to minimal levels. This is desirable because at present wage rates are at a high level. Articles produced with a high labor cost therefor must be sold at a high price and the market is therefor diminished.

It is therefore an object of the present invention to provide a casing which will go at least some distance towards meeting the foregoing desiderata or which will at least provide the public with a useful choice.

Accordingly the invention consists in a casing comprising a shell member having a transverse cross section in the form of an inverted substantially square bottomed U, a bottom panel closing part of the space between the ends of the arms of said U-shaped shell member opposite the top of said U-shaped shell member, a back panel closing part of space between said arms of said shell member, said bottom panel and said back panel not extending to their common boundary and a compartment panel engaged between said back panel and said bottom panel.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWING

One preferred form of the invention will now be described with reference to the accompanying drawing which is an exploded view of one form of casing according to the invention.

DETAILED DESCRIPTION

In the invention a casing comprises an outer shell 1 which has a cross section which is substantially in the form of an inverted square bottomed U having arms 2 and a top 3. Engaged with the outer shell 1 is a back panel 4 and a bottom panel 5. The bottom panel 5 bridges between the free ends of the arms 2 and the back panel 4 engages the arms 2 and the top 3 but the bottom panel 5 and the back panel 4 do not extend to their point of mutual engagement. Thus, a gap is provided, referring to the FIGURE, at the bottom of the back panel 4 and the back of the bottom panel 5. This gap is closed by a compartment panel 6 which is engaged between the back panel 4 and the bottom panel 5. The compartment panel comprises a horizontal part 7 and a vertical part 8 meeting at the fold line.

In order to satisfactorily engage the panels together the arms 2 and the top 3 may be formed with channels 10 which have a plane substantially parallel to the arms 2 and top 3 and the back panel 4 has an inturned substantially perpendicular rib or flange 11 which engages into the channels 10 and may include lanced out locking tabs thereon so that once engaged a relatively permanent lock is provided. To this end the edge 12 of the sheet 1 is turned into the channel 10.

Similarly the bottom panel 5 may have upturned flanges 13 which engage into channels 14 similarly positioned.

A similar engagement mechanism may be provided between the compartment panel 6 and the back panel 4 and bottom panel 5 and thus channels 15 may be provided into which flanges 16 and 17 are positioned. Again, for example, by lancing out locking tabs, a relatively permanent lock may be provided.

End panels 18 may be provided between the compartment panel 6 and the arms 2 and these may have a flange 19 thereon which spaces the bulk of the panel 18 from the arms 2 so that a space or gap is provided which in use may be filled, for example, with foamed in place polyurethane foam as an insulant and also strengthening agent for the construction.

The casing so formed may have a central cross member 20 which is engaged with end mouldings 21, for example, by providing a slot in the end mouldings 21 into which the cross member 20 may be positioned and the end moulding 21 may be engaged with an inturned flange 22 on the outer shell 1. The end mouldings 21 are engaged with the flange 22 for example, by fixing screws 23 and are locked to cross member 20 by rivets 24 which pass through cross member 20 and end mouldings 21.

A hinge pin (of the same type as hinge pin 26) may be engaged in either end moulding 21 to allow mounting of either left hand or right hand opening doors, for example, on a two door refrigerator or freezer or refrigerator/freezer. Cross member 20 and end mouldings 21 may be deleted of course for a single door cabinet.

The front edge of the bottom panel 5 is formed to a shape, in particular, so that it will form a bottom cross member to meet and seal with the bottom edge for example of a refrigerator or a freezer door. The cross member 20 also serves this purpose. The bottom panel 5 and arms 2 are further located together by a corner moulding 27 which has slots therein to receive the edges such as edges 28 of the returned edge of the bottom panel 5. The corner moulding 27 also has stepped formation 29 on the rearward facing face thereof against which the lower end of channel 30 abuts. The bottom channel 14 is wrapped about the formation 29 in use. A captive nut 31 may fit into a slot 32 in the moulding 27 so that a bolt 33 may be passed through a suitable aperture to engage the nut 31 to provide front foot rests.

The moulding 27 also receives pins such as pins 26 which provide the bottom of a door hinge and several hinges may be provided which may be affixed by screws 34 to the outer surface of the top 3 and the hinge bracket 35 also includes a door hinge pin 36 so that a door may be hung in the refrigerator and/or freezer compartments and the door may be hung at either side, that is, the doors may be either left or right handed. A tapped plate 37 is provided to accept screws 34 or plugs 38.

A rivet 39 is provided to engage in the other moulding 27 that is to say, the moulding which does not include hinge pin 36.

In order to form the casing to, for example, a refrigerator, a liner (not shown) may be positioned within the casing so described and engaged, for example, into return channels such as channels 30 and foamed in situ insulation positioned to form a refrigerator or freezer.

The construction is erected by forming the parts described and preferably, for example, pre-finishing them and then locating the parts together by engaging the appropriate flanges and channels to provide a rigid constructions.

Thus, it can be seen that a casing is provided which at least in the preferred form of the invention has some advantages. Thus, the major components of the casing may be pre-formed and preferably pre-finished where they may then be assembled in a relatively simple manner to form an assembled casing. Thus, the assembly can be, to a substantial extent, automated and that is to say, the manual input is reduced to simply the final press engagements of the parts to form the refrigerator. Thus, the total man hours required to assemble the refrigerator casing may be substantially reduced over what have till now been conventional methods.

We claim:

1. A casing comprising a shell member having a transverse cross section in the form of a substantially square bottomed U, a bottom panel closing part of the space between the ends of the arms of said U-shaped shell member opposite the base of said U-shaped shell member, a back panel closing part of the space between said arms of said shell member, said bottom panel and said back panel not extending to a common boundary, a compartment panel engaged between said back panel and said bottom panel, and end panels at the ends of said compartment panel which are positioned adjacent said outer shell, said end panels having spacing flanges thereon so that a gap is provided between said outer shell and said end panels.

2. A casing comprising a shell member having a transverse cross section in the form of a substantially square bottomed U, a bottom panel closing part of the space between the ends of the arms of said U-shaped shell member opposite the base of said U-shaped shell member, a back panel closing part of the space between said arms of said shell member, said bottom panel and said back panel not extending to a common boundary, a compartment panel engaged between said back panel and said bottom panel, channels in the edges of said compartment panel adjacent said back panel and said bottom panel, said channels being substantially parallel to the plane of said compartment panel at that point, and said back panel and said bottom panel having flanges thereon which engage into the respective adjacent channels on said compartment panel.

3. A casing comprising a shell member having a transverse cross section in the form of a substantially square bottomed U, a bottom panel closing part of the space between the ends of the arms of said U-shaped shell member opposite the base of said U-shaped shell member, a back panel closing part of the space between said arms of said shell member, said bottom panel and said back panel not extending to a common boundary, and a compartment panel engaged between said back panel and said bottom panel, said bottom panel being shaped and said arms being shaped to receive a corner member having slots to receive part of said bottom panel and protrusions to engage parts of said arms.

* * * * *